United States Patent [19]

Johnson et al.

[11] Patent Number: 4,714,037

[45] Date of Patent: Dec. 22, 1987

[54] NEEDLE LOOPER ASSEMBLY FOR NON-THREADED NEEDLE LOCKSTITCHING

[75] Inventors: Ralph E. Johnson, Convent Station; Donald Rodda, Butler, both of N.J.

[73] Assignee: The Singer Company, Stamford, Conn.

[21] Appl. No.: 292,071

[22] Filed: Aug. 12, 1981

Related U.S. Application Data

[63] Continuation of Ser. No. 97,599, Nov. 26, 1979, abandoned.

[51] Int. Cl.[4] ..... D05B 57/08

[52] U.S. Cl. ..... 112/184; 112/221

[58] Field of Search ..... 112/54, 98, 181, 184, 112/191, 221, 223

[56] References Cited

U.S. PATENT DOCUMENTS

| | | | |
|---|---|---|---|
| 968,066 | 8/1910 | Moore | 112/54 |
| 1,152,482 | 9/1915 | Brown | 112/54 |
| 1,284,646 | 11/1918 | Gammeter | 112/54 |
| 2,003,461 | 6/1935 | Pearson | 112/221 X |
| 2,426,636 | 9/1947 | Monroe | 112/98 |
| 3,777,682 | 12/1973 | Tooming et al. | 112/184 X |
| 4,245,577 | 1/1981 | Zocher | 112/184 X |

*Primary Examiner*—W. C. Reynolds

*Attorney, Agent, or Firm*—Robert E. Smith

[57] ABSTRACT

A needle looper assembly for a lockstitch sewing machine wherein the upper thread is retrieved by a sewing needle extending through a work material, which sewing needle has an extensible hook portion for catching an upper thread and drawing the same down through the work material to a looptaker in the bed of the sewing machine. The needle looper assembly is supported on the end of a lever pivotally carried in the sewing machine bed to extend transversely thereof. The lever has the needle looper assembly attached to one end thereof, and may be actuated by a cam so as to drive the needle looper assembly to an elevated thread catching position or to a retracted thread releasing position. Retaining means are provided associated with the needle looper to permit an upper thread to be caught and held during passage through a work material and to be released when in a retracted position adjacent the looptaker.

5 Claims, 7 Drawing Figures

Fig.2
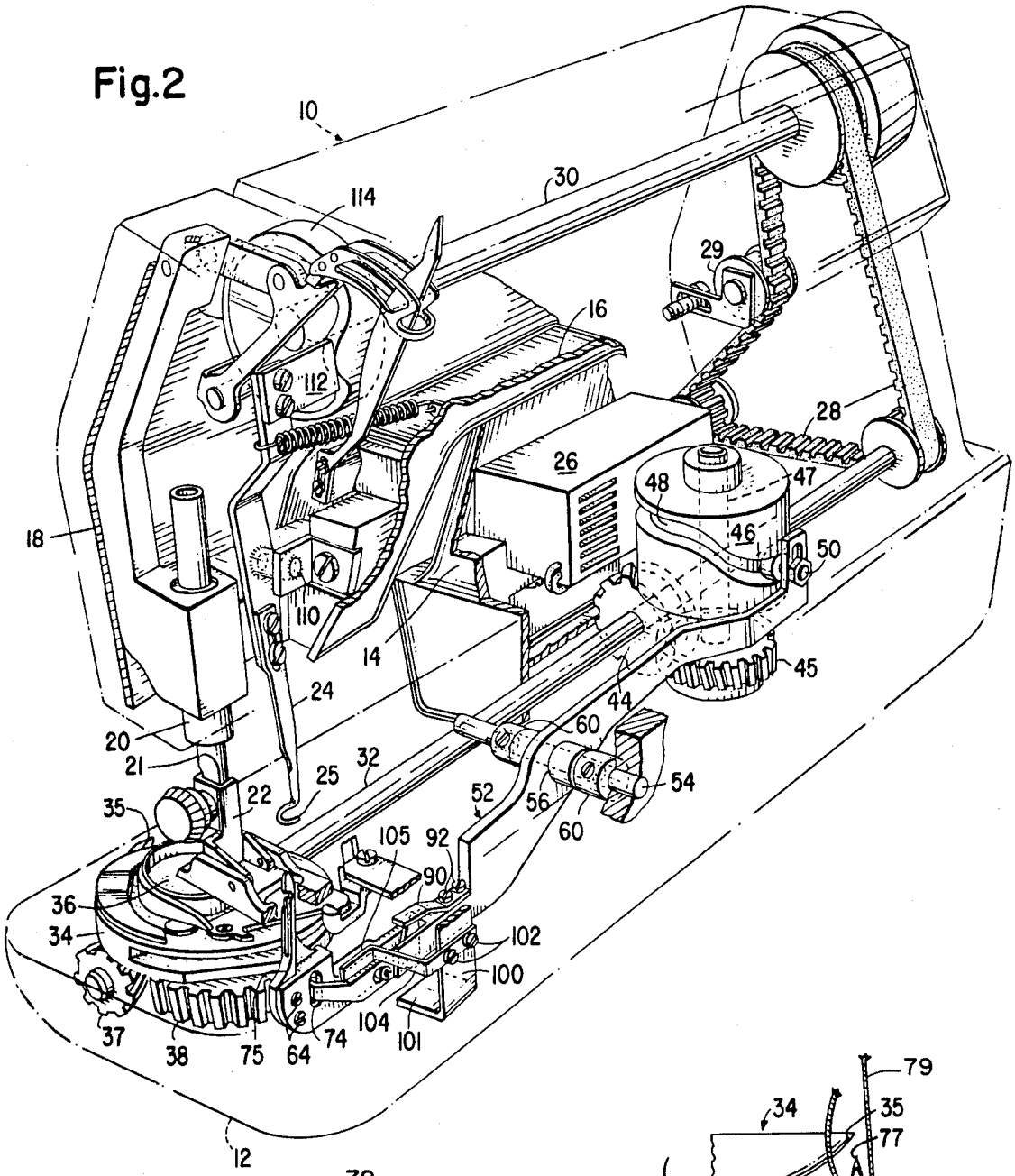
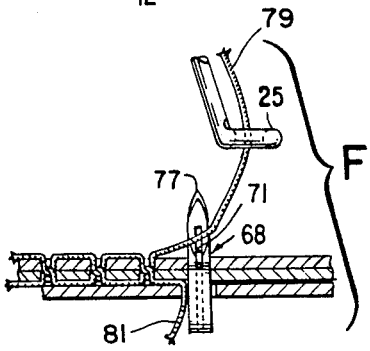
Fig.7
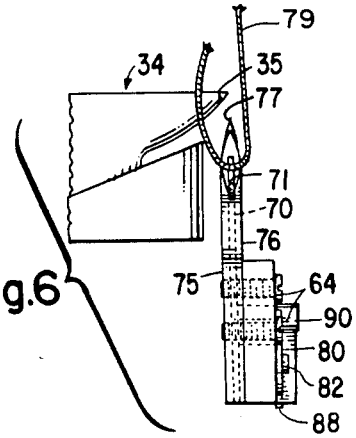
Fig.6

NEEDLE LOOPER ASSEMBLY FOR NON-THREADED NEEDLE LOCKSTITCHING

This is a continuation of U.S. patent application Ser. No. 097,599 filed on Nov. 26, 1979, now abandoned.

BACKGROUND OF THE INVENTION

This invention is concerned with sewing machines; more particularly, with a needle looper assembly for lockstitching with a non-threaded needle.

Until somewhat recently, lockstitch sewing machines utilized an upper needle having a thread carrying eye located at the tip thereof to carry a loop of upper thread downwardly through a work material to a loop taker for pick up thereby and concatenation about a lower thread. However, a system was disclosed in U.S. Pat. No. 4,245,577 issued on Jan. 20, 1981, application Ser. No. 033,297, filed on Apr. 25, 1979, which utilized a needle looper extending upwardly through a work material to receive a loop of upper thread and draw this upper thread down to a looptaker. The upper thread was then taken by the looptaker and passed about a lower thread supply to concatenate the upper thread with the lower thread so as to form a lockstitch. In this prior art device, a needle looper assembly was used which was vertically reciprocated by a crank arrangement, and utilized a special cam to generate relative movement between an outer needle and an inner rod which carried a hook on the extremity thereof. This orientation of the needle looper assembly is rather cumbersome in that it greatly enlarges the depth of the sewing machine bed.

What is required is a simplified arrangement of a needle looper assembly which requires substantially less vertical room so as to be compatible with the accepted envelope for a sewing machine frame. It would be further desirable to simplify actuation of the arrangement for capturing the upper needle thread, as well as the arrangement for sweeping the upper thread into the needle looper.

SUMMARY OF THE INVENTION

In the invention, the needle looper assembly is placed at the extremity of a lever situated transversely in the sewing machine bed and pivoted thereto. A barrel cam is provided in the sewing machine bed to be driven by the actuating means for the sewing machine, which cam has a cam track therein engaged by a follower carried by the lever. Thus, the needle looper assembly carried on the end of the lever may be pivoted upwardly through a work material and downwardly through the work material to a looptaker in synchronism with the feeding motion of the sewing machine and the looptaker. The needle looper assembly comprises an upstanding needle having a sharpened point, with an open eyelet portion located just below the point. A slider is formed as part of the needle looper assembly in order to, in one position thereof, close off the open eyelet portion, leaving only a closed thread carrying eyelet portion. Means are provided for having the eyelet portion opened when the needle looper assembly is in its uppermost and in its lowermost positions. With the needle looper assembly in its uppermost position and the eyelet portion open, the upper thread is encouraged to enter the open eyelet portion by a thread wiper actuated by a face cam supported on the horizontal arm shaft of the sewing machine. With the needle looper assembly in its lowermost position and the eyelet portion open, a looptaking beak of the looptaker extends over the looper assembly between the thread limbs extending upwardly therefrom so as to take the loop of upper thread from the needle looper assembly.

DESCRIPTION OF THE DRAWINGS

The subject matter which is regarded as the invention is particularly pointed out and distinctly claimed in the concluding part of this specification. The invention itself, however, both as to its organization and method of operation thereof may be best understood by reference to the following description taken in connection with the accompanying drawings, in which:

FIG. 2 is a perspective view of a sewing machine of the type used in combination with the present invention, with the frame thereof shown in phantom and components shown in elevation;

FIG. 6 is a side elevation of a portion of the sewing machine looptaker and needle looper assembly to show the arrangement of the parts thereof during loop pick up; and, FIG. 7 is a section taken along line 7—7 of FIG. 1 to show how the upper thread is directed into the open eyelet of the needle looper.

Referring now to FIG. 1, there is shown an elevation of a sewing machine 10 in which the invention may be incorporated. The sewing machine 10 includes a bed portion 12 on one end of which is supported a standard 14 rising therefrom and supporting a bracket arm 16 overhanging the bed. The bed portion 12 is of a uniform height over its entire width and is less than ⅓ of total machine frame height. The bracket arm 16 terminates in a head portion 18 within which is supported a presser bar bushing 20, which bushing slidably supports a presser bar 21 to the end of which is attached a presser foot 22. The presser foot 22 is utilized to press a work material against feeding dogs supported in the bed portion 12 of the sewing machine so as to feed a work material through the sewing machine. However, the feeding dogs and feed system will be omitted herein so as to more clearly disclose the invention of the transverse needle looper assembly. Also visible in FIG. 1 is the thread wiper 24 whose purpose and operation will be described below. Some indication of the operation these components and non-threaded needle lockstitch sewing may be had by reference to the U.S. Pat. No. 4,245,577, issued on Jan. 20, 1981 and assigned to the same assignee as the present invention, which application is hereby incorporated by reference herein.

Referring now to FIG. 2, the internal portions of the sewing machine shown in FIG. 1 are visible except for the feed dogs and feeding system which, as stated above, are omitted so that the invention may be more clearly disclosed. Thus, there is shown the drive motor 26 which is connected by belt 28 to the horizontal arm shaft 30 and the looptaker drive shaft 32. An idler pulley 29 is provided so that the proper tension may be maintained in the belt 28. The looptaker drive shaft 32 drives a rotating looptaker 34 by means of gears 37, 38.

Figure 1:
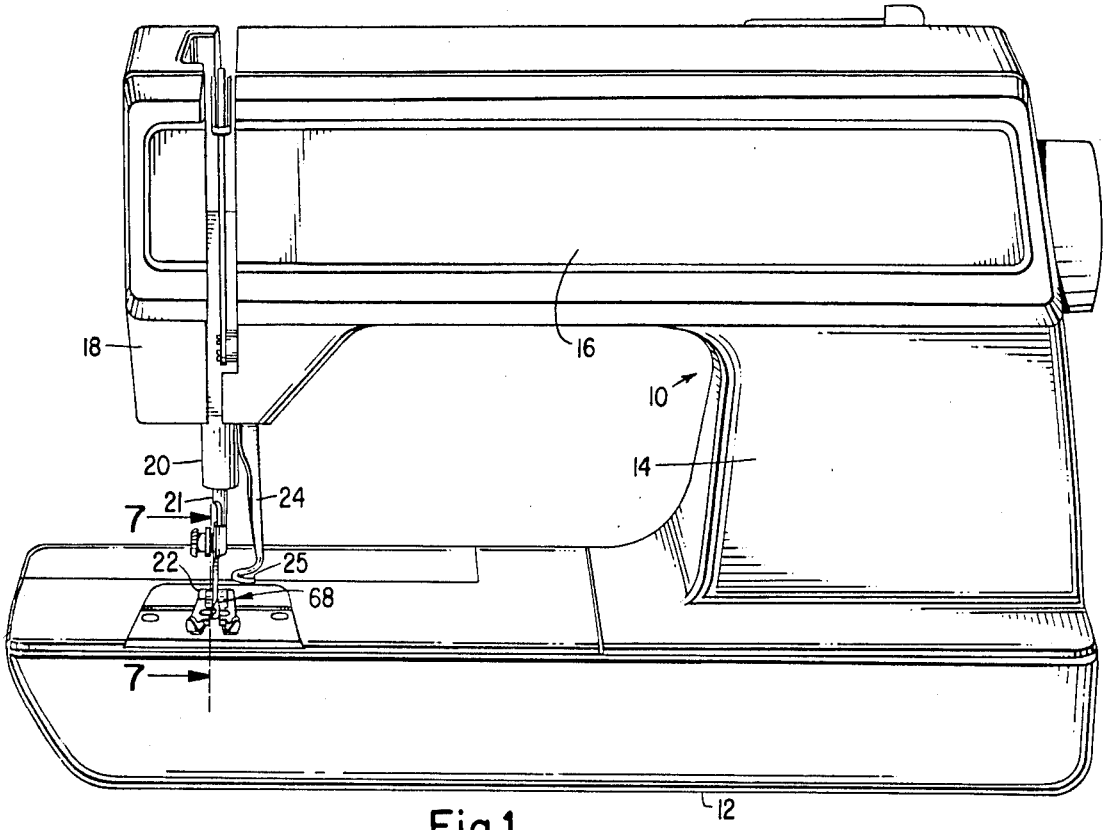
FIG. 1 is an elevation of a sewing machine to which an embodiment of this invention has been applied.
Figure 3:
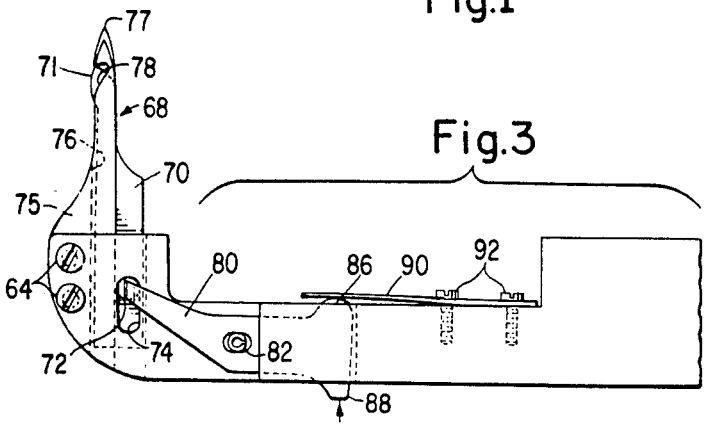
FIG. 3 is an elevation of a portion of the lever shown in FIG. 2 with the needle looper assembly attached thereto and shown with the needle eyelet thereof closed.

A second set of gears 44, 45 drives a cam 46 supported on shaft 47 carried by the sewing machine frame. The cam 46 is fashioned with a cam track 48, into which cam track extends cam follower 50 affixed to one end of pivoted lever 52 carried transversely in the bed portion 12 of the sewing machine 10.

The lever 52 supports a journal box 56 approximately midway thereof, the journal box accommodating a pivot shaft 54 upon which the lever may pivot. The pivot shaft 54 is carried by the bed portion 12 of the sewing machine frame, there being collars 60 affixed to the pivot shaft to maintain the position of the lever 52 upon the shaft.

Figure 5:
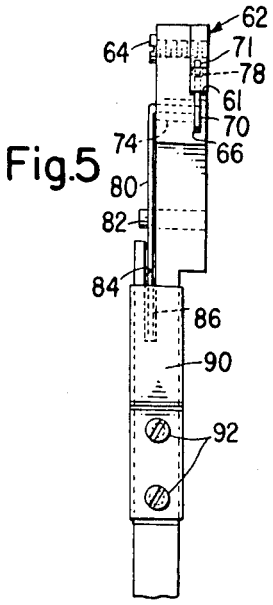
FIG. 5 is a plan view of the needle looper assembly and the end of the lever to show details thereof.
Figure 4:
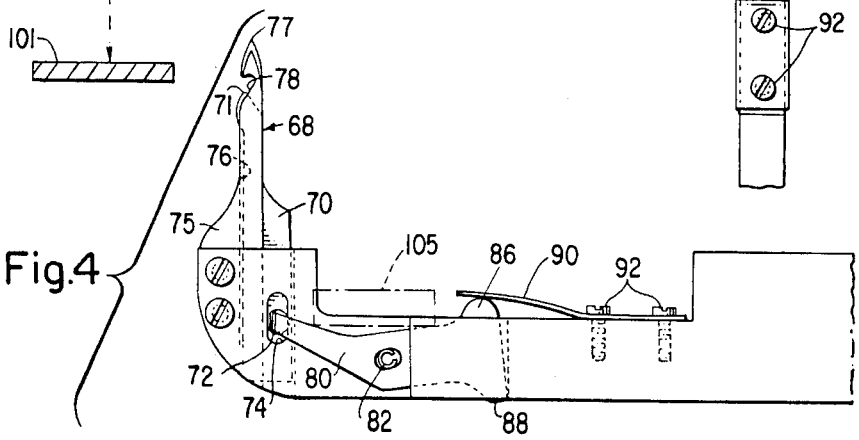
FIG. 4 is a view similar to FIG. 3 showing, however, the eyelet of the needle looper assembly open for receiving or releasing thread.

The opposite end of the lever 52 is fashioned with a vertical rabbet 61 to accommodate a needle looper assembly 62, which is held thereto by screws 64 (see also FIG. 5). A surface of the vertical rabbet 61 is fashioned with a slot 66 to accommodate a slider 70 portion of the needle looper assembly 62. The needle looper assembly 62 further includes a needle 75 which is fashioned with an upstanding needle portion 76 terminating in a point 77, just below which is located an open eyelet portion 78. The needle 75 is retained substantially normal to the lever 52, and the needle is grooved from one side thereof through the upstanding needle portion 76 to the open eyelet portion 78 in order to accommodate the slider 70 and the extremity 71 thereof which cooperates with the open eyelet portion 78 of the upstanding needle portion 76 to form a closed eyelet portion. The lower portion of the slider 78 is fashioned with an aperture 72, which aperture is aligned with a vertical slot 74 in the pivoted lever 52.

A link 80 is pivoted on a pin 82 fastened to the lever 52. The forward end of the link 80 is bent inwardly to pass through the aperture 72 in the slider 70. The pivoted lever 52 is further fashioned with a enlarged groove 84 (see FIG. 5) to accommodate an extension to the link 80 having enlarged upper 86 and lower 88 projections, dimensioned so as to project one at a time, above or below the pivoted lever. A leaf spring 90 is fastened to the top of the pivoted lever 52 by screws 92, and rests against upper projection 86 of link 80 so as to maintain slider 70 normally in a position where the extremity 71 closes the eyelet portion 78 of the needle 75.

Referring once again to FIG. 2, there is apparent a bracket 100 carried by the bed portion 12 of the sewing machine 10. The bracket 100 is formed with a base portion 101, and has affixed to a vertical portion thereof by screws 102, a laterally extending arm 104. The laterally extending arm 104 is fashioned with a offset limb 105 which extends over the link 80 so that, upon upward movement of the needle looper assembly 62 through a work material, the slider 70 will be maintained in one position by the connection of the forward end of the link 80 through the aperture 72 of the slider. Thus, when the needle looper assembly is in its uppermost position, the extremity 71 of the slider 70 will be withdrawn into the upstanding needle portion 76 of the needle 75, and the eyelet portion 78 will be open. The base portion 101 of the bracket 100 extends below the lower projection 88 of the link 80 so that downward motion of the needle looper assembly 62 the lower projection 88 of the link 80 will strike the base portion and cause the link to pivot about the pin 82 to move the slider 70 and uncover the eyelet portion 78 so as to permit upper thread 79 to be taken therefrom by the rotating looptaker 34. Referring to FIG. 6, it can be seen that the rotating looptaker 34 is fashioned with a looptaking beak 35 which extends beyond the body of the rotating looptaker and above the needle looper assembly 62 when located in the lowermost position. With the eyelet portion 78 open, the looptaking beak 35 is able to take the upper thread 79 off the needle looper assembly for concatenation with a lower thread 81 contained in a bobbin 36 supported internally of the rotating looptaker 34.

In operation, when the needle looper assembly 62 extends upwardly through a work material under the urgings of the cam track 48 on the cam 46, the offset limb 105 on the laterally extending arm 104 carried by the sewing machine frame impinges on the link 80, causing the link to rotate about the pivot pin 82 and lower the slider relative to the upstanding needle portion 76 of the needle 75 so as to uncover the eyelet portion 78 therein. Thereupon, a hook portion 25 of the thread wiper 24, which wiper is urged in a counterclockwise direction about the pivot 110 therefor due to the action of the follower 112 impinging on face cam 114 attached to the end of the horizontal arm shaft 30, will traverse a curve to take an upper thread 79 extending between the last stitch point in a work material supported beneath the presser foot 22 and extending upwardly through the sewing machine arm to a thread supply, and urge this thread into the eyelet potion 78 of the needle looper assembly 62 (see FIGS. 1 and 7). Thereafter, needle looper assembly 62 will be retracted through the work material, the link 80 rotating clockwise about the pin 82 under the influence of the leaf spring 90 impinging on the projection 86, when the link no longer engages with the offset limb 105 of the laterally extending arm 104. The thread 79 trapped in the eyelet portion 78, which is now closed by the extremity 71 of the slider 70, will be drawn through the work material to a lower position beneath the level of the looptaking beak 35 of the rotating looptaker 34. On continued downward motion of the needle looper assembly 62, the lower projection 88 of the link 80 will strike the base portion 101 of the bracket 100 affixed to the sewing machine frame, causing the link 80 to rotate in a counterclockwise direction against the urgings of the leaf spring 90. Thereby, the extremity 71 of the slider 70 will be retracted and the eyelet portion 78 will be open so that the upper thread retained therein may be plucked therefrom by the looptaking beak 35 of the rotating looptaker 34 as it passes over the needle looper assembly 62, between the thread limbs extending from the eyelet portion. The loop of thread thus taken from the needle looper assembly 62 may be concatenated with the lower thread 81 carried by bobbin 36 supported within the rotating looptaker 34. Subsequent stitching is accomplished in the same manner.

We claim:

1. A needle looper assembly for a lockstitch sewing machine having a frame of a total height and including a bed of uniform height less than ⅓ of said total height, a drive means supported within said frame, a looptaker driven by said drive means, said needle looper assembly being supported in said bed and being used to draw a loop of upper thread down through a work material supported on said bed to said looptaker for concatentation with a lower thread; said needle looper assembly comprising:

a lever pivotally carried within said bed, a needle rigidly clamped to one end of said lever substantially normal thereto, a means associated with said needle for selectively retaining said upper thread; means driven by said drive means for oscillating said lever to urge said needle to an elevated position through said work material and to a retracted position adjacent said looptaker; and, means supported within said bed for actuating said retaining means for receiving said upper thread when extended through said work material, for retaining said upper thread when traveling through said work material to said retracted position adjacent said looptaker, and for releasing said upper thread to said looptaker when retracted to said position adjacent said looptaker.

2. A needle looper assembly for a lockstitch sewing machine having a frame of a total height and including a bed of uniform height less than ⅓ of said total height, a drive means supported within said frame, a looptaker driven by said drive means, said needle looper assembly being supported in said bed and being used to draw a loop of upper thread down through a work material to said looptaker for concatenation with a lower thread; said needle looper assembly comprising:

a lever pivotably carried within said bed, a cam follower affixed to said lever, a needle rigidly clamped to one end of said lever substantially normal thereto, a means associated with said needle for selectively retaining said upper thread; a cam supported in said frame and driven by said drive means, said cam having a track therein followed by said cam follower of said lever for urging said needle to an elevated position through said work material and to a retracted position adjacent said looptaker; and, means supported by said bed for actuating said retaining means for receiving an upper thread when extended to said elevated position through said work material, for retaining said upper thread when traveling through said work material to said retracted position adjacent said looptaker, and for releasing said upper thread to said looptaker when retracted to a position adjacent said looptaker.

3. A needle looper assembly as claimed in claim 2 wherein said retaining means further includes an eyelet opening on the side of said needle adjacent the tip thereof, on that portion of said needle which extends above said work material when in said elevated position, and means for directing said upper thread into said eyelet opening on the side of said needle when said needle extends above said work material, said directing means including only a single thread wiper having a hook portion traversing a curve to take said upper thread and urge the same to said eyelet of said needle when said needle is in said elevated position with said upper thread extending from the last stitch point in said work material, and, means for constraining said thread wiper to have said hook portion thereof traverse said curve when said needle extends above said work material in said elevated position.

4. A needle looper assembly as claimed in claim 3 wherein said retaining means is implemented by a groove extending along the edge of said needle to said eyelet thereof, a slider retained in said groove and having a portion thereof effective in one position of said slider for closing said eyelet opening and effective in another position thereof for exposing said eyelet opening, and wherein said actuating means is implemented by means for selectively actuating said slider to a selected position including a link pivotally connected to said lever pivotably carried in said bed, said link having a portion thereof connected with said slider, resilient means fastened to said lever for urging said link to a position for closing said eyelet opening of said needle, and means supported by said sewing machine frame for moving said link against the bias of said resilient means when said needle is in said elevated position through said work material and in said retracted position adjacent said looptaker.

5. A needle looper assembly as claimed in claim 4 wherein said looptaker is fashioned with a body and a looptaker beak, said looptaking beak extending beyond the periphery of said body, whereby said needle affixed to said lever may be urged to said elevated position and to said retracted position adjacent said looptaker body, and while in said retracted position said looptaking beak will travel a path above said needle and between the upper thread limbs extending to the loop of upper thread retained in said eyelet opening of said needle.

* * * * *